US011014740B2

(12) United States Patent
Ahern

(10) Patent No.: US 11,014,740 B2
(45) Date of Patent: May 25, 2021

(54) SYSTEM AND METHOD FOR MODULAR BUILDING DEEP FREEZER

(71) Applicant: XTREME CUBES CORPORATION, Henderson, NV (US)

(72) Inventor: Don Francis Ahern, Las Vegas, NV (US)

(73) Assignee: Xtreme Cubes Corporation, Henderson, NV (US)

( * ) Notice: Subject to any disclaimer, the term of this patent is extended or adjusted under 35 U.S.C. 154(b) by 66 days.

(21) Appl. No.: 16/293,889

(22) Filed: Mar. 6, 2019

(65) Prior Publication Data

US 2019/0276228 A1 Sep. 12, 2019

Related U.S. Application Data

(60) Provisional application No. 62/640,637, filed on Mar. 9, 2018.

(51) Int. Cl.

| | |
|---|---|
| ***B65D 88/74*** | (2006.01) |
| ***F25D 23/06*** | (2006.01) |
| ***F25D 3/10*** | (2006.01) |
| ***F25D 13/02*** | (2006.01) |

(52) U.S. Cl.

CPC ..... *B65D 88/745* (2013.01); *F25D 3/105* (2013.01); *F25D 13/02* (2013.01); *F25D 23/063* (2013.01)

(58) Field of Classification Search

CPC ..... B65D 88/745; F25D 23/063; F25D 3/105; F25D 13/00; F25D 13/02; F25D 11/00; F25D 11/04; E04H 5/10

See application file for complete search history.

(56) References Cited

U.S. PATENT DOCUMENTS

| | | | | |
|---|---|---|---|---|
| 3,392,497 | A * | 7/1968 | Cushman | E04B 1/6183 52/272 |
| 3,529,389 | A | 9/1970 | Wilkins | |
| 3,559,357 | A | 2/1971 | Lowe | |
| 5,953,928 | A | 9/1999 | Saia, III et al. | |
| 6,826,879 | B1 | 12/2004 | Allen et al. | |
| 6,925,761 | B1 | 8/2005 | De La Marche | |
| 8,033,067 | B2 | 10/2011 | Miller | |
| 9,459,037 | B2 | 10/2016 | Wood et al. | |
| 9,625,206 | B2 | 4/2017 | Ma et al. | |
| 10,034,484 | B2 | 7/2018 | Tanaka et al. | |
| 10,155,693 | B1 | 12/2018 | Spreen | |
| 10,166,550 | B2 | 1/2019 | Tahkio et al. | |
| 2006/0053825 | A1* | 3/2006 | Owen | A01N 1/0257 62/441 |
| 2009/0095006 | A1* | 4/2009 | Smith | F25D 23/063 62/259.1 |
| 2017/0215620 | A1* | 8/2017 | Dade | F25D 25/02 |

* cited by examiner

*Primary Examiner* — Emmanuel E Duke

(74) *Attorney, Agent, or Firm* — Armstrong Teasdale LLP

(57) ABSTRACT

A freezer including a plurality of self-supporting planar wall structures surrounding an interior volume, a floor member comprising a portion of a modular cube structure, and a refrigeration unit thermally coupled to the interior volume and configured to maintain a temperature of the interior volume less than −40.0° C.

15 Claims, 9 Drawing Sheets

SYSTEM AND METHOD FOR MODULAR BUILDING DEEP FREEZER

CROSS REFERENCE TO RELATED APPLICATIONS

This application claims priority to and the benefit of the filing date of U.S. Provisional Application No. 62/640,637 filed on Mar. 9, 2018, which is hereby incorporated by reference in its entirety.

BACKGROUND

This description relates to maintaining plant and animal material at low temperatures and, more particularly, to a deep freezer arrangement for a modularly constructed building.

BRIEF DESCRIPTION

In one embodiment, a freezer includes a plurality of self-supporting planar wall structures surrounding an interior volume, a floor member comprising a portion of a modular cube structure, and a refrigeration unit thermally coupled to the interior volume and configured to maintain a temperature of the interior volume less than −40.0° C.

In another embodiment, a method of forming a deep freezer in a modular cube structure includes forming a plurality of planar wall structures into a room surrounding an interior volume wherein each of the plurality of planar wall structures includes a wall foot, a wall head, and a wall member extending therebetween. The plurality of planar wall structures are free-standing with respect to the modular cube structure. The method also includes coupling a ceiling member to the formed room and coupling said plurality of planar wall structures to at least one of a floor structure of said modular cube structure and a deep freezer floor structure separate from said modular cube floor structure.

In still another embodiment, a modular cube structure includes a free-standing freezer positioned within said modular cube structure. The modular cube structure includes a floor structure, a plurality of modular cube wall structures defining a modular cube interior volume, and a plurality of freezer wall structures surrounding a portion of the interior volume. Each of the plurality of planar wall structures includes a wall foot, a wall head, and a wall member extending therebetween. The wall foot of the plurality of freezer wall structures are coupled to at least one of the floor structure of the modular cube and a freezer floor structure separate from the modular cube floor structure. The plurality of freezer wall structures are unimpeded from expanding and contracting by a connection to the modular cube structure.

BRIEF DESCRIPTION OF THE DRAWINGS

FIG. 1 is a plan view of an example umbilical corridor coupled to a plurality of modular cube structures in accordance with an example embodiment of the present disclosure.

FIG. 2 is a plan view of a plurality of corridor segments coupled together end-to-end to form an umbilical corridor.

FIG. 3 is a perspective end view of a corridor segment (shown in FIG. 1).

FIG. 4 is a plan view of an example of a joint between adjacent ones of the umbilical corridor segments shown in FIG. 1.

FIG. 5 is a plan view of another example of a modular cube structure that may be used with the umbilical corridor shown in FIG. 1.

FIG. 6 is a side elevation view of a portion of the modular cube structure shown in FIG. 1 that includes the freezer shown in FIG. 5.

FIG. 7 is a system diagram of an ultra-low temperature (ULT) refrigeration system that may be used with the freezer shown in FIG. 5.

FIG. 8 is a side view of the freezer shown in FIG. 5 within the modular cube structure shown in FIG. 1.

FIG. 9 is a flow chart of a method of the forming deep freezer shown in FIG. 5 in the modular cube structure shown in FIG. 1.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to construction of modular facilities in industrial, commercial, and residential applications.

The following description refers to the accompanying drawings, in which, in the absence of a contrary representation, the same numbers in different drawings represent similar elements.

Figure 1:
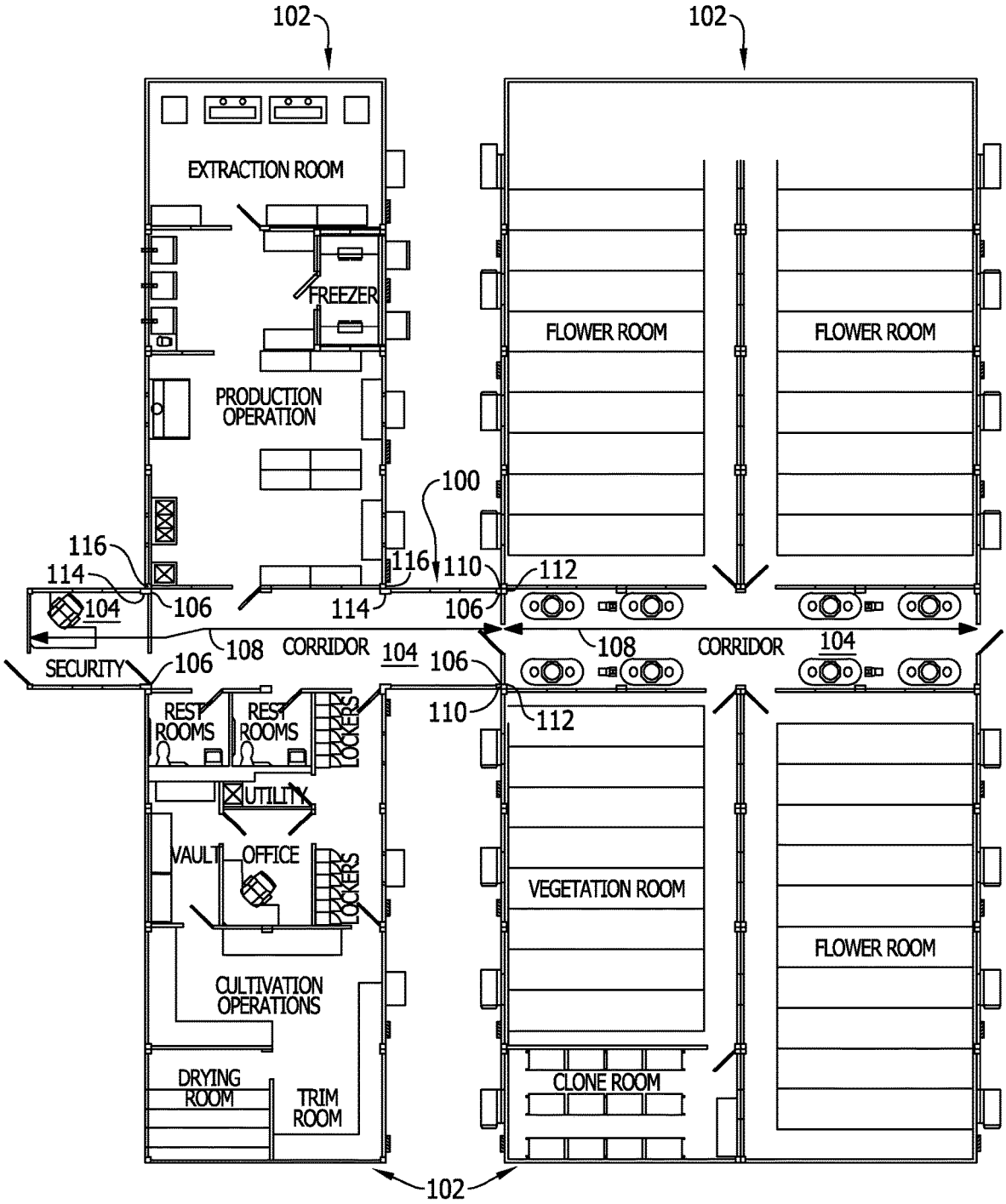
FIGS. 1-9 show example embodiments of the method and apparatus described herein.
Figure 2:
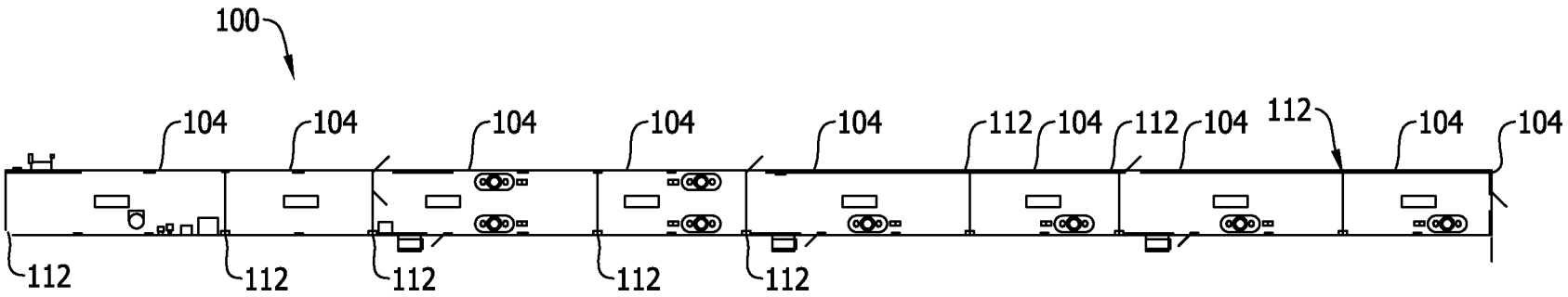

FIG. 1 is a plan view of an example umbilical corridor 100 coupled to a plurality of modular cube structures 102 in accordance with an example embodiment of the present disclosure. FIG. 2 is a plan view of a plurality of corridor segments 104 coupled together end-to-end to form umbilical corridor 100. Umbilical corridor 100 is formed from a plurality of hollow elongate corridor segments 104 coupled together using flanges 106 formed integrally into each corridor segments 104. Corridor segments 104 have a predetermined length 108. Each of the plurality of corridor segments 104 includes a first end flange 110 couplable to a complementary second end flange 112 of an adjacent one of the plurality corridor segments 104. Each of the plurality of corridor segments 104 may also include a side flange 114 couplable to a complementary end flange 116 of an adjacent modular cube structure 102. Each corridor segments 104 also includes a plurality of service conduits (not shown in FIG. 1) extending from end flange 116 of corridor segment 104 to at least the side flange 114 of the respective corridor segment 104. Typically, the plurality of service conduits extends from end flange 116 to an opposite end flange of corridor segment 104.

Figure 3:
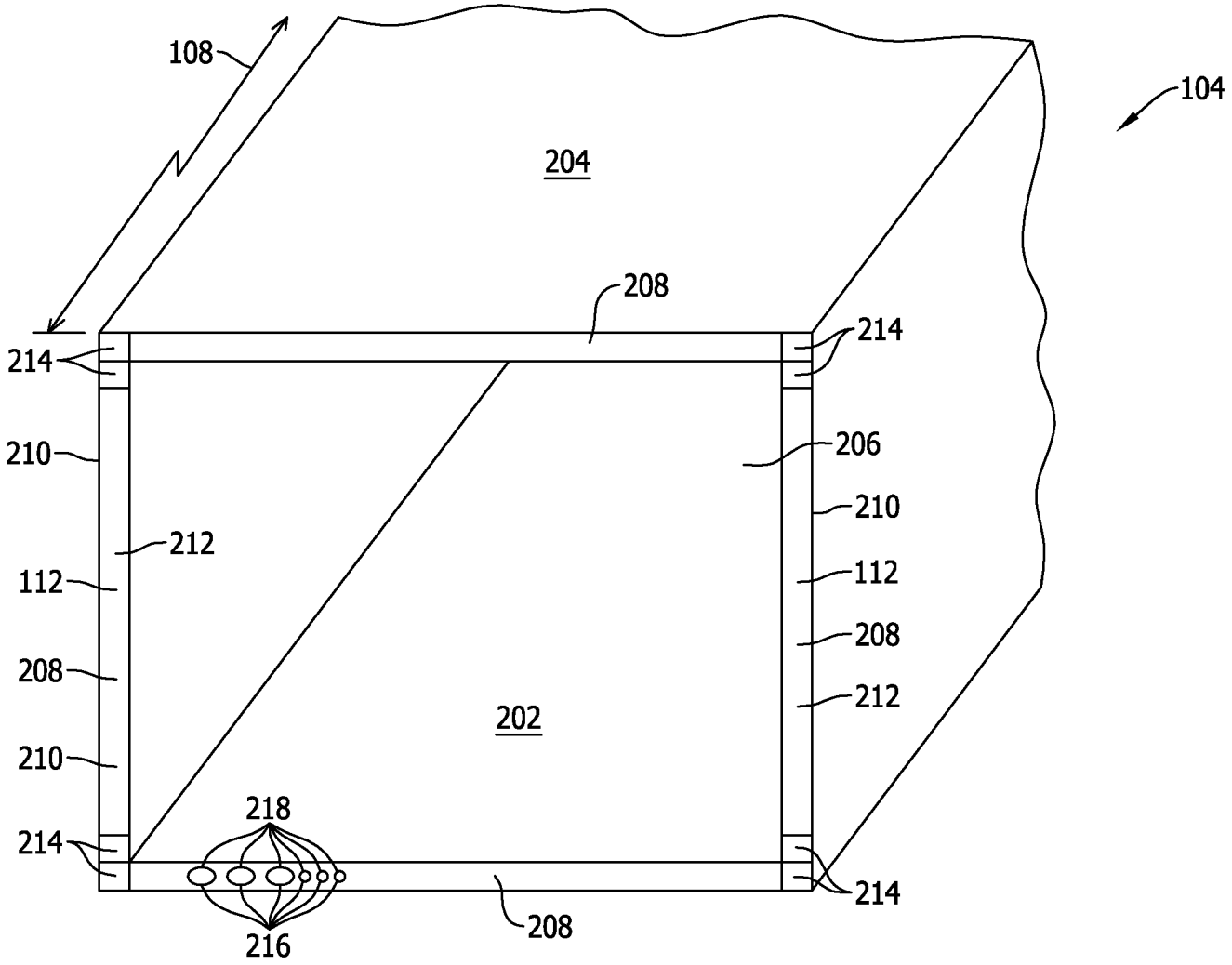

FIG. 3 is a perspective end view of a corridor segment 104 (shown in FIG. 1). In the example embodiment, corridor segment 104 includes a floor member 202 and a roof member 204 extending the predetermined length 108. Second end flange 112 circumscribes a hollow passageway interior 206. Second end flange 112 includes a plurality of members coupled together to provide a mating surface 208 for adjacent corridor segments 104 to be connected together. Second end flange 112 includes a vertical flange member 210 including a structural column member 212 and a cube corner assembly 214 fixedly coupled to at least one end of structural column member 212. In some embodiments, second end flange 112 includes a single cube corner assembly 214 in at least some corners of second end flange 112. In other embodiments, second end flange 112 includes a plurality of single cube corner assemblies 214 in at least some corners of second end flange 112. While described as being couplable together end-to-end, adjacent corridor segments 104 can also be configured to couple together side-by-side.

A plurality of service conduits 216 may extend between the first end flange 110 and second end flange (not shown in FIG. 2) within floor member 202 and/or within roof member 204. A distal end 218 of conduits 216 are fitted with couplings (not shown in FIG. 2) that are complementary with couplings of an adjacent corridor segment 104. In various embodiments, the plurality of service conduits include at least one of electrical supply conduits, control and instrumentation signal conduits, plumbing conduits, sewer/waste liquid conduits, heating, ventilating, and air conditioning (HVAC) conduits, and security and surveillance signal conduits.

Figure 4:
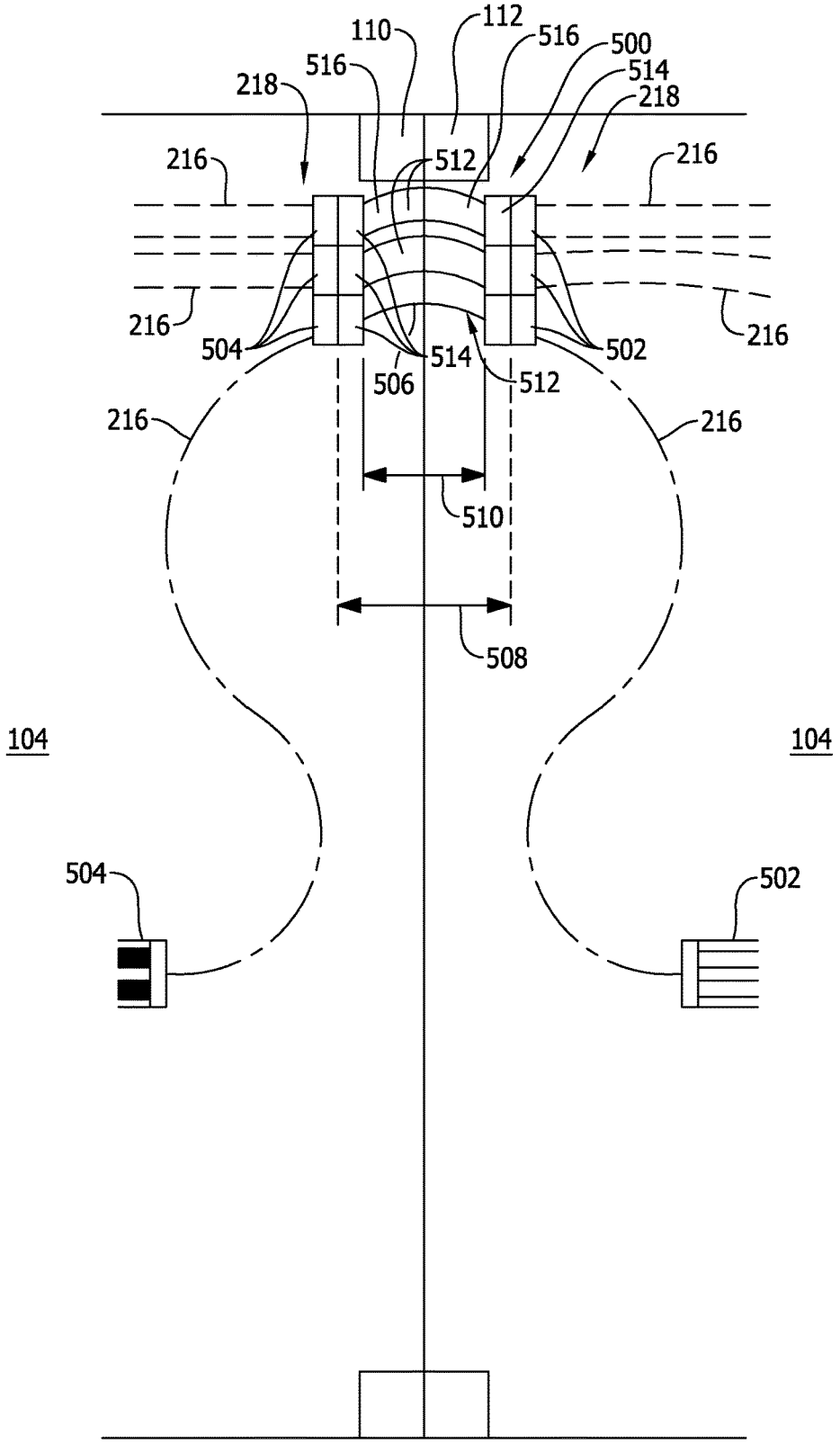

FIG. 4 is a plan view of an exemplary joint 500 between adjacent ones of the umbilical corridor segments 104 (shown in FIGS. 1 and 2). A plurality of service conduits 216 may extend between the first end flange 110 and second end flange 112 within floor member 202 and/or within roof member 204 (shown in FIG. 2). A distal end 218 of conduits 216 are fitted with couplings 502 that are complementary with couplings 504 of an adjacent corridor segment 104. In some embodiments, pigtails 506 are used to bridge a gap 508 between couplings 502 and 504. Each pigtail 506 includes a length 510 of appropriate conduit 512 and mating couplings 514 on each end 516.

Figure 5:
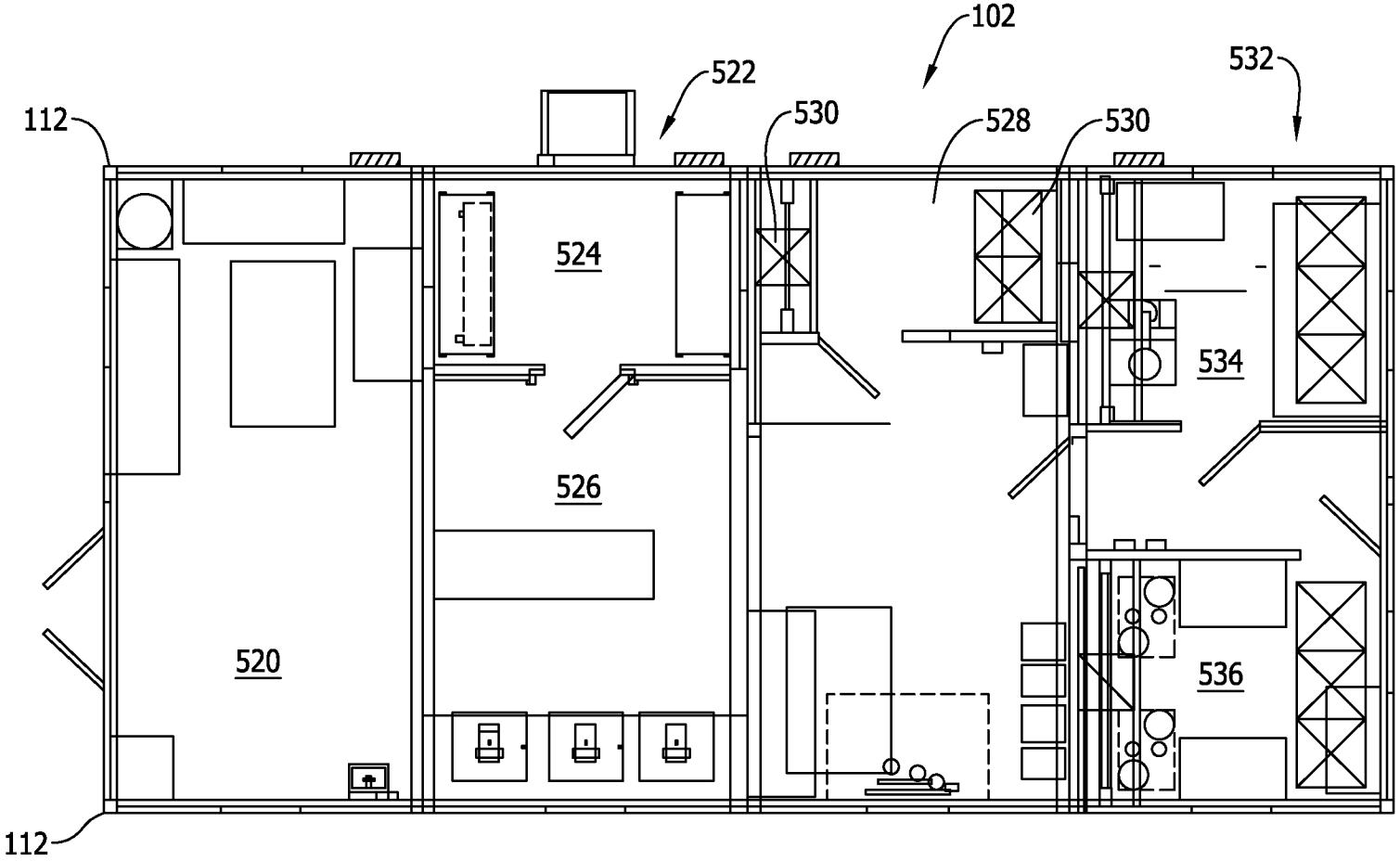

FIG. 5 is a plan view of another example of a modular cube structure 102 that may be used with umbilical corridor 100 shown in FIG. 1. In the example embodiment, modular cube structure 102 includes a plurality of rooms, which may be configured to support a particular step of a process. The process may entail the cultivation of plant or animal life, the harvesting of the plant or animal life, processing the plant or animal life, extracting valuable materials from the plant or animal life, and preparing the residue of the plant or animal life for disposal. Some of the rooms are configured to support potentially hazardous operational steps or hazardous material within them. Some of the rooms may be subject to industrial codes or other restrictions on their construction or processes. For example, a first room 520 may be a production/operation where aspects of the process are carried out, initiated, monitored, and/or controlled. A second room 522 may include a freezer 524 and an area 526 that supports freezer process operations. A third room 528 may be used for an extraction step of the process. An extraction step may remove the valuable material from the plant or animal life being processed. Such a step may yield the valuable component being sought, waste gases, and waste solids. The waste gases may need to be captured for a forced air exhaust system 530 and exhausted outside modular cube structure 102 before the waste gas builds to a hazardous concentration. In the example embodiment, a fourth room 532 includes two additional production rooms 534 and 536 to facilitate increasing production levels of the valuable component.

Figure 6:
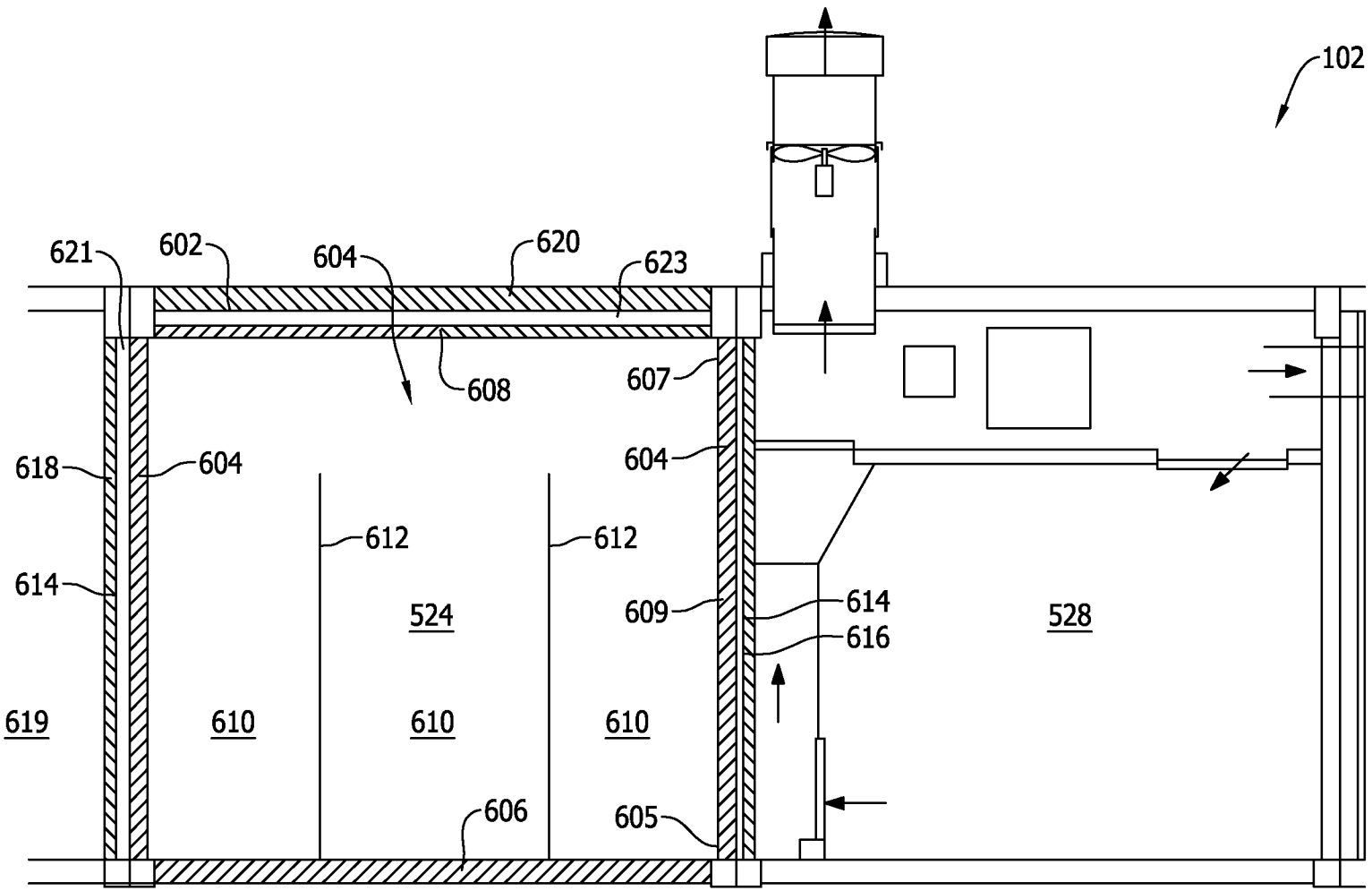

FIG. 6 is a side elevation view of a portion of modular cube structure 102 (shown in FIG. 1) that includes freezer 524. In the example embodiment, freezer 524 is a free-standing structure formed within modular cube structure 102. As used herein, "free-standing" refers to freezer 524 being structurally and thermally isolated from other components and structures of modular cube structure 102. For example, a freezer envelope is formed of a plurality of wall structures 604, a floor structure 606, and a ceiling or roof structure 608. Each of plurality of planar wall structures 604 includes a wall foot 605, a wall head 607, and a wall member 609 extending therebetween. Each of the plurality of wall structures 604 may be formed of separate insulated panels 610 abutted edge-to-edge at a joint 612. Wall structures 604 may abut face-to-face with a wall structure 614, 618 of an adjacent compartment, such as, first room 520, area 526, and third room 528. Some of wall structures 614 may include a thermal insulative layer including an insulation material, 616. Some of wall structures 614, 618 may be uninsulated. Some of wall structures 604 may not abut face-to-face with any other wall structure, for example, an interior wall 618 between freezer 524 and a controlled-environment space 619. A gap 621 between wall structures 604 and 618 facilitates separation of freezer 524 from modular cube structure 102, which permits freedom of movement of freezer 524 during thermal expansion and contraction. Ceiling structure 608 may abut face-to-face with an outside insulated roof panel 620 or may be separated from outside insulated roof panel 620 by a gap 621. Floor structure 606 may abut face-to-face with an insulated or uninsulated modular cube floor structure 622. Wall structures 614 may include three inches or greater of for example, a foam insulation material 616 having an R-value of R-21 or greater. In various embodiments, foam insulation material 616 may include a spray foam of for example, polyurethane or other chemical product that may be formed of for example, isocyanate and a polyol resin. Floor structure 606 typically is formed of an approximately four inch thick spray foam insulation material, 616 having an R-value of R-28 or greater. Ceiling structure 608 is typically formed a spray foam insulation material, 616 having an R-value of R-36 or greater and extending approximately six inches thick. In other embodiments, insulation material other than polyurethane foam can be used, for example, expanded polystyrene (EPS) and extruded polystyrene (XPS). The R-values of insulation material 616 may be selected to account for variations in each installation. Likewise, a thickness of insulation material 616 may be selected based on an R-value selected and an insulative quality of insulation material 616.

Freezer 524 is supported by floor structure 606 and/or modular cube floor structure 622, but in the example embodiment, is a self-supporting structure, in that there are no structural attachments between freezer 524 and modular cube structure 102 other than through floor structure 606. Being free-standing permits freezer 524 to thermally expand and contract without stressing other components of modular cube structure 102.

Figure 7:
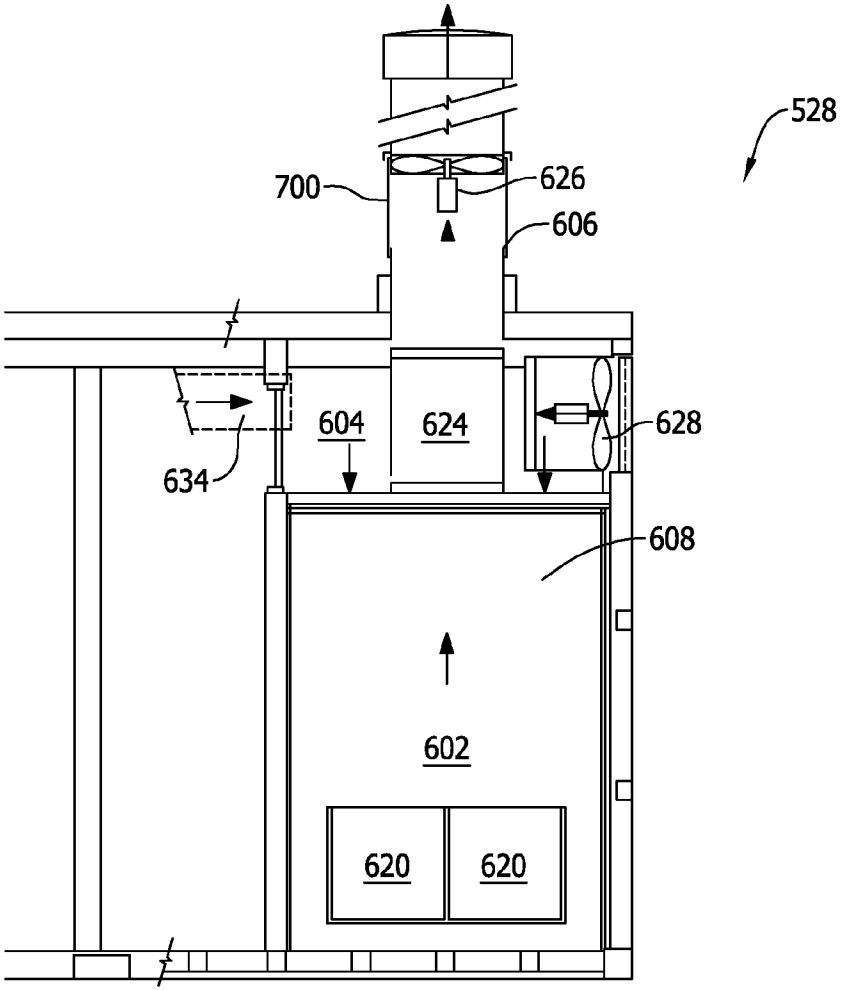

FIG. 7 is a system diagram of an ultra-low temperature (ULT) refrigeration system 700 that may be used with freezer 524 (shown in FIG. 5). In the example embodiment, refrigeration system 700 includes, in serial flow communication, an evaporator 702, a compressor 704, a condenser 706, a receiver 708, a filter drier 710, and a metering device 712. A temperature sensor 714 is used to control a flow through metering device 712. In one embodiment, evaporator 702 and/or condenser 706 use a fan 716, 718 to facilitate heat exchange in their respective coils. In various embodiments, evaporator 702 and/or condenser 706 use a liquid heat exchanger to facilitate heat exchange. In the example embodiment, ULT refrigeration system 700 has a temperature range of less than approximately −86° C. to less than approximately −45° C. In other embodiments, refrigeration system 700 has a temperature range of less than approximately −100° C. to less than approximately −50° C.

Figure 8:
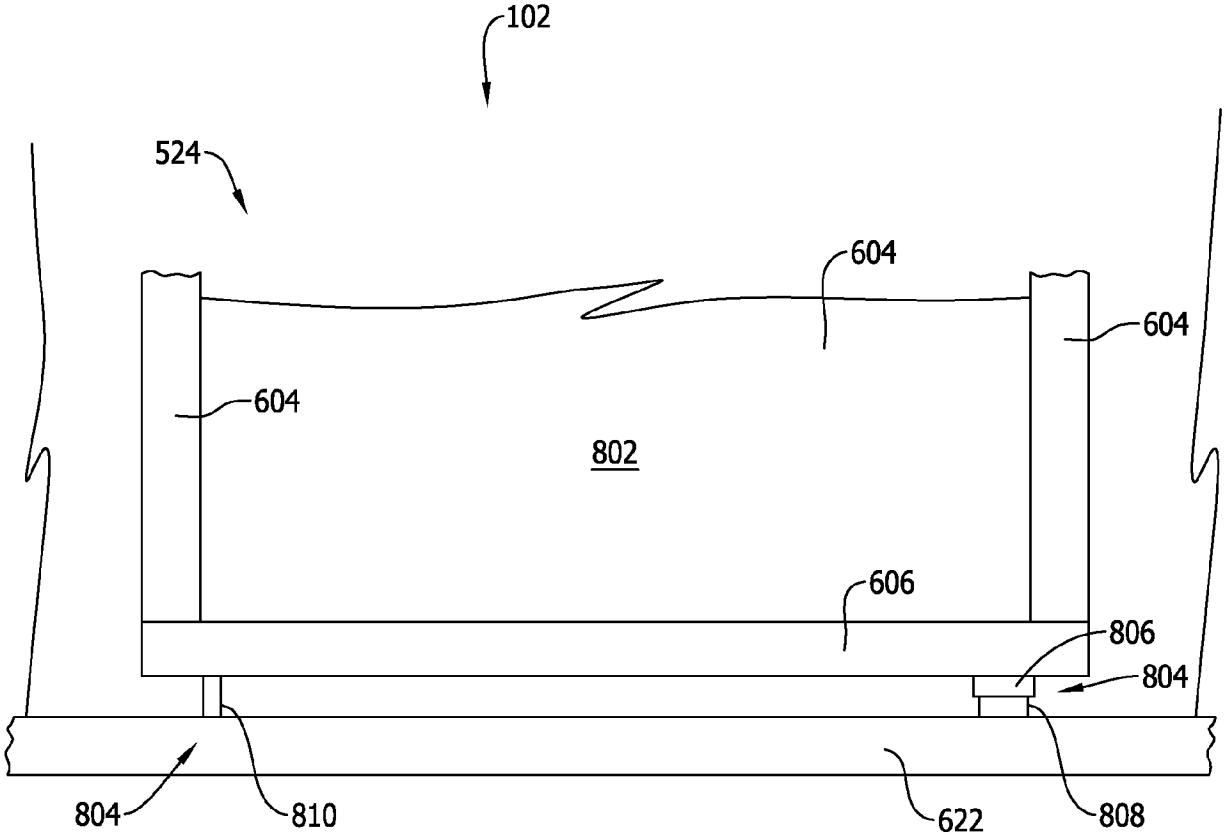

FIG. 8 is a side view of freezer 524 within modular cube structure 102. In the example embodiment, freezer 524 includes a plurality of self-supporting planar wall structures 604 surrounding an interior volume 802. Plurality of self-supporting planar wall structures 604 are unimpeded from expanding and contracting by any connection to modular cube structure 102. Planar wall structures 604 are coupled to freezer floor structure 606. In the example embodiment, freezer floor structure 606 is separate from a floor structure or modular cube floor structure 622. Freezer 524 is permitted to move, expand, and contract using at least one slip joint 804 positioned between freezer floor structure 606 and modular cube floor structure 622. At least one slip joint system 804 includes a slip pad 806 positioned face-to-face with a slip base 808. Slip pad 806 and slip base 808 are free to slide with respect to each other to permit slip pad 806 to move as expansion and contraction of freezer 524 dictates. At least one slip joint system 804 includes a pivotable pinned connection 810 between freezer floor structure 606 and modular cube floor structure 622.

Figure 9:
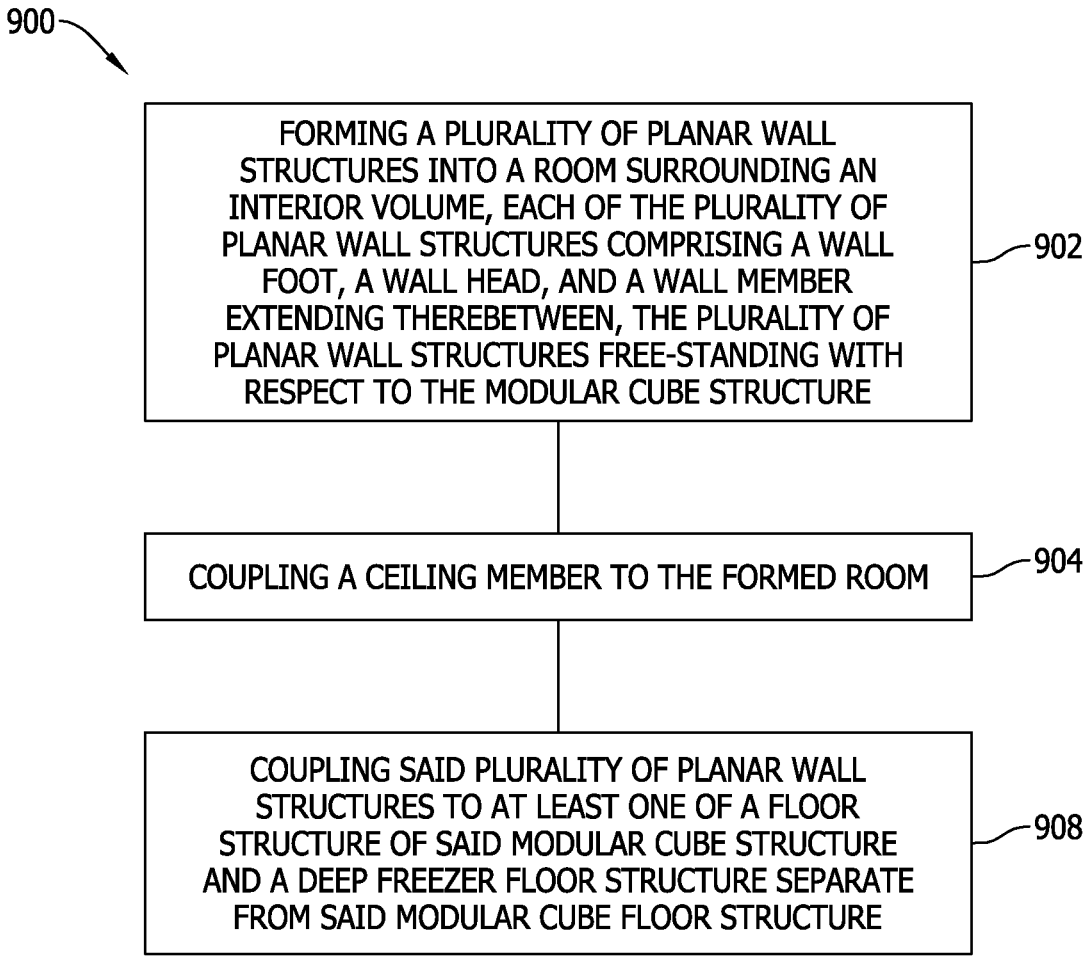

FIG. 9 is a flow chart of a method 900 of forming deep freezer 524 in a modular cube structure 102. In the example embodiment, method 900 includes forming 902 plurality of planar wall structures 604 into a room surrounding interior volume 802 wherein the plurality of planar wall structures 604 are free-standing with respect to modular cube structure 102. Method 900 also includes coupling 904 ceiling structure 608 to the formed room, and coupling 906 plurality of planar wall structures 604 to at least one of modular cube floor structure 622 and deep freezer floor structure 606 that is separate from modular cube floor structure 622. Method 900 optionally includes pivotally coupling deep freezer floor structure 606 to modular cube floor structure 622. Pivotally coupling deep freezer floor structure 606 to modular cube floor structure 622 may be performed using pivotable pinned connection 810. Other areas of deep freezer floor structure 606 may be slidably coupled to modular cube floor structure 622 using slip joint system 804, which includes slip pad 806 positioned face-to-face with slip base 808.

The foregoing detailed description illustrates embodiments of the disclosure by way of example and not by way of limitation. It is contemplated that the disclosure has general application to construction of components within structures, in particular, modular structures. It is further contemplated that the methods and systems described herein may be incorporated into existing construction systems and structures, in addition to being maintained as a separate stand-alone structure.

It will be appreciated that the above embodiments that have been described in particular detail are merely example or possible embodiments, and that there are many other combinations, additions, or alternatives that may be included. While the disclosure has been described in terms of various specific embodiments, it will be recognized that the disclosure can be practiced with modification within the spirit and scope of the claims.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Also, as used herein, the terms "substantially" or "about" are intended to indicate a condition within reasonably achievable manufacturing and assembly tolerances, relative to an ideal desired condition suitable for achieving the functional purpose of a component or assembly. By way of an example, an assembly of components in "substantial" alignment to a common axis of rotation may deviate from perfectly co-axial alignment so long as all the components can rotate as intended for accomplishing the functional purpose of the assembly.

The above-described embodiments of a freezer having an ultra-low temperature (ULT) refrigeration system provides a cost-effective and reliable means for providing energy efficient cooling to ultra-low temperatures in a modular and expandable multi-use facility. More specifically, the freezer and ULT refrigeration system described herein facilitates thermally insulating the freezer from adjacent components thereby reducing thermal pathways between the freezer and the adjacent components. In addition, the above-described freezer reduces a number of structural pathways from the modular cube structure to the freezer. As a result, the freezer and ULT refrigeration system described herein facilitate fresher valuable product in a cost-effective and reliable manner.

Example structures and components for assembling an ULT freezer are described above in detail. The structures illustrated are not limited to the specific embodiments described herein, but rather, components of each may be utilized independently and separately from other components described herein. Each system component can also be used in combination with other system components.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A freezer within a modular cube structure, said freezer comprising:

a plurality of self-supporting planar wall structures surrounding an interior volume, the plurality of self-supporting planar wall structures unimpeded from expanding and contracting by a connection to the modular cube structure, the planar wall structures coupled to a freezer floor structure, wherein:

said freezer floor structure is slidably coupled to a floor structure of the modular cube structure via a slip joint system that includes i) a first slidable connection between said freezer floor structure and the floor structure of the modular cube structure, and ii) a second pivotable connection pinned between said freezer floor structure and the floor structure of the modular cube structure; and a refrigeration system thermally coupled to the interior volume and configured to maintain a temperature of the interior volume less than −40.0° C.

2. The freezer of claim 1, wherein said refrigeration unit is configured to maintain the temperature of the interior volume less than −86.0° C.

3. The freezer of claim 1, wherein said freezer and modular cube structure share a common area of the floor structure.

4. The freezer of claim 1, wherein the first slidable connection to the floor structure of the modular cube structure and the second pivotable connection to the floor structure of the modular cube structure enable said freezer floor structure to freely expand and contract independently of the floor structure.

5. The freezer of claim 1, wherein said at least one slip joint comprises a slip pad positioned face-to-face with a slip base, and wherein the slip pad is slidable with respect to the slip base and defines the first slidable connection.

6. A method of forming a deep freezer in a modular cube structure, said method comprising:

forming a plurality of planar wall structures into a room surrounding an interior volume, each of the plurality of planar wall structures comprising a wall foot, a wall head, and a wall member extending therebetween, the plurality of planar wall structures free-standing with respect to the modular cube structure;

coupling a ceiling member to the formed room;

coupling said plurality of planar wall structures to a freezer floor structure;

slidably coupling the freezer floor structure to a modular cube floor structure at a first location using a first slidable connection; and pivotably coupling the freezer floor structure to the modular cube floor structure at a second location using a second pivotable connection.

7. The method of claim 6, wherein pivotably coupling the freezer floor structure to the modular cube floor structure comprises pivotably coupling the freezer floor structure to the modular cube floor structure using a pivotable pinned connection.

8. The method of claim 6, wherein slidably coupling the freezer floor structure to the modular cube floor structure comprises slidably coupling the freezer floor structure to the modular cube floor structure using a slip joint.

9. The method of claim 8, wherein the slip joint comprises a slip pad positioned face-to-face with a slip base, the slip pad slidable relative to the slip base.

10. A modular cube structure including a free-standing freezer positioned within said modular cube structure, said modular cube structure comprising:

a floor structure;

a plurality of modular cube wall structures defining a modular cube interior volume; and a plurality of freezer wall structures surrounding a portion of the interior volume, each of the plurality of modular cube wall structures comprising a wall foot, a wall head, and a wall member extending therebetween, the wall foot of said plurality of freezer wall structures coupled to at least one of said floor structure of said modular cube structure and a freezer floor structure separate from said modular cube floor structure, said plurality of freezer wall structures unimpeded from expanding and contracting by a connection to the modular cube structure, wherein:

the freezer floor structure is slidably coupled to the floor structure of the modular cube structure via a slip joint system that includes i) a first slidable connection between the freezer floor structure and the floor structure of the modular cube structure, and ii) a second pivotable connection pinned between the freezer floor structure and the floor structure of the modular cube structure.

11. The modular cube structure of claim 10, further comprising a freezer ceiling coupled to said wall heads of said plurality of freezer wall structures, said freezer ceiling separate from said modular cube structure.

12. The modular cube structure of claim 10, wherein each of said plurality of freezer wall structures, said freezer ceiling, and said freezer floor structure comprises a thermal insulative layer having an R-value of R-21 or greater.

13. The modular cube structure of claim 10, wherein each of said plurality of freezer wall structures comprises a thermal insulative layer having an R-value of R-28 or greater.

14. The modular cube structure of claim 10, wherein each of said plurality of freezer wall structures comprises a thermal insulative layer having an R-value of R-36 or greater.

15. The modular cube structure of claim 10, further comprising a refrigeration system thermally coupled to the interior volume and configured to maintain a temperature of the interior volume less than −40.0° C.

* * * * *